US006675554B1

(12) United States Patent
Hanten et al.

(10) Patent No.: US 6,675,554 B1
(45) Date of Patent: Jan. 13, 2004

(54) METHOD AND DEVICE FOR CLOSING PACKAGINGS MADE OF FLEXIBLE MATERIAL

(75) Inventors: Jürgen Hanten, Rockenberg (DE); Günter Vermehren, Usingen (DE); Gerhard Demmig, Bickenbach (DE)

(73) Assignee: Poly-Clip System GmbH & Co. KG, Frankfurt am Main (DE)

( * ) Notice: Subject to any disclaimer, the term of this patent is extended or adjusted under 35 U.S.C. 154(b) by 0 days.

(21) Appl. No.: 09/889,266

(22) PCT Filed: Jan. 7, 2000

(86) PCT No.: PCT/EP00/00061

§ 371 (c)(1),
(2), (4) Date: Jan. 2, 2002

(87) PCT Pub. No.: WO00/41933

PCT Pub. Date: Jul. 20, 2000

(30) Foreign Application Priority Data

Jan. 14, 1999 (DE) ..... 199 01 220

(51) Int. Cl.[7] ..... B65B 51/04; A22C 11/12
(52) U.S. Cl. ..... 53/138.4; 452/30; 452/48
(58) Field of Search ..... 29/515, 243.56, 29/282, 283.5; 53/138.4, 417; 72/330; 452/48, 30, 34, 37, 38

(56) References Cited

U.S. PATENT DOCUMENTS 3,015,824 A * 1/1962 Richardson ..... 72/399
3,158,189 A * 11/1964 Balsaur et al.
3,343,253 A * 9/1967 Omori ..... 140/11
3,380,226 A * 4/1968 Tracy ..... 53/138.4
3,455,010 A * 7/1969 Busler ..... 29/564.6
3,748,690 A * 7/1973 Niedecker ..... 452/31
3,864,494 A * 2/1975 Kupcikevicius et al. .... 426/284
3,975,795 A * 8/1976 Kupcikevicius et al. ..... 452/38
4,571,805 A * 2/1986 Niedecker ..... 227/120
4,796,332 A * 1/1989 Stanley ..... 452/48
4,938,002 A * 7/1990 Evans et al. ..... 29/243.56
5,136,824 A * 8/1992 Niedecker ..... 53/138.4
5,497,645 A * 3/1996 Niedecker ..... 29/243.56
6,101,785 A * 8/2000 Bienert et al. ..... 53/138.3
6,205,747 B1 * 3/2001 Paniagua Olaechea ..... 227/120
6,219,998 B1 * 4/2001 Demming et al. ..... 140/11

FOREIGN PATENT DOCUMENTS

DE 1 078 495 * 3/1960
DE 3148757 A1 * 6/1983 ..... B65D/33/16
DE 37 05 829 8/1988
GB 920335 * 7/1959

* cited by examiner

*Primary Examiner*—Rinaldi I. Rada
*Assistant Examiner*—Paul R Durand
(74) *Attorney, Agent, or Firm*—Norris McLaughlin & Marcus

(57) ABSTRACT

A device for closing packages made of flexible material, wherien a portion of the flexible material is gathered into a neck, the neck is inserted into and overlaps a U-shaped clip, the overlapping portions of the neck are formed in a direction perpendicular to the base of the clip to hold the neck against the base, and the legs of the clip are closed.

4 Claims, 2 Drawing Sheets

METHOD AND DEVICE FOR CLOSING PACKAGINGS MADE OF FLEXIBLE MATERIAL

Figure 1:
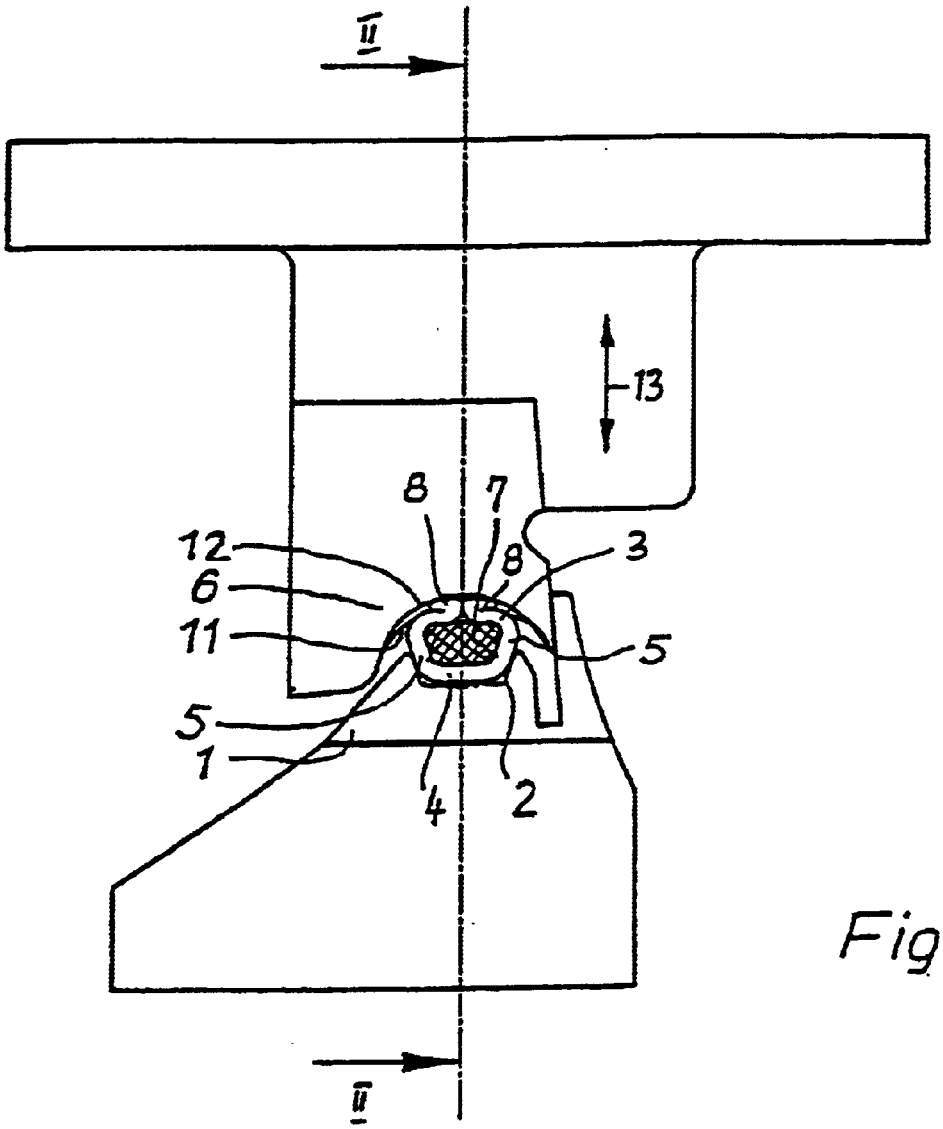

This is a 371 of PCT/EP00/00061, which was filed Jan. 7, 2000.

This invention relates to a method for closing packages made of flexible material such as bags, tubes or the like, wherein a portion of the packaging material is gathered to form a neck and the same is inserted into an open, substantially U-shaped closure clip with a clip base and clip legs on both sides, whereupon the legs of the closure clip are bent around the neck in the form of a ring. The invention furthermore relates to a device for performing this method, comprising a matrix for holding the open closure clip and a punch movable towards the matrix for bending the clip legs around the neck of the packaging material.

From DE 38 44 052 C1, for instance, there is known such closing of for instance sausage ends including the closure clips and closing tools used for this purpose. The closure clips prebent to form a U are hanging on each other by means of webs crimped at the leg ends and form a strand of clips which can be supplied as a magazine, from which strand of clips the respective closure clip is cut off—in the middle of the connecting web with the next closure clip in the strand of clips—during the working stroke of the closing tools. During the closing operation, the web end portions are urged against the outside of the clip legs and together with the same are bent around the neck of the packaging material, the leg ends and leg portions being urged against each other and thereby upset, so that there is obtained a ring pressing together the neck of the packaging material as tightly as possible.

This technology has been quite successful. However, in certain cases, especially in the case of relatively rigid packaging material, malfunctions can occur due to the fact that the neck, which has been formed for instance by displacement shears and has been inserted into the still open closure clip, slightly snaps back and when the clip is subsequently closed, the same damages the packaging material so that the package, for instance a sausage casing, becomes leaky.

This deficiency should be eliminated by means of the invention. The method of the invention consists in that after inserting the neck and before bending the clip legs the neck is urged towards the plane of the clip base axially beside the closure clip. In this way, the neck is prevented from deploying towards the opening of the clip not yet closed, and during the subsequent closing operation the bent legs of the closure clip are prevented from squeezing and damaging a fold of the neck. There can also be used a closure clip with shorter legs, which especially in the case of a thin neck of the packaging material requires less upsetting work during the closing operation and promotes a tight closure of the neck.

The device provided for performing this method is characterized by at least one hold-down device laterally attached to the punch in direction of the neck, the effective area of said hold-down device protruding beyond the working surface of the punch in direction of movement thereof by a small amount. This amount may be about 1 to 5 mm, preferably it is 2 to 3 mm. Further preferred embodiments of this device are also subject-matter of sub-claims.

Figure 2:
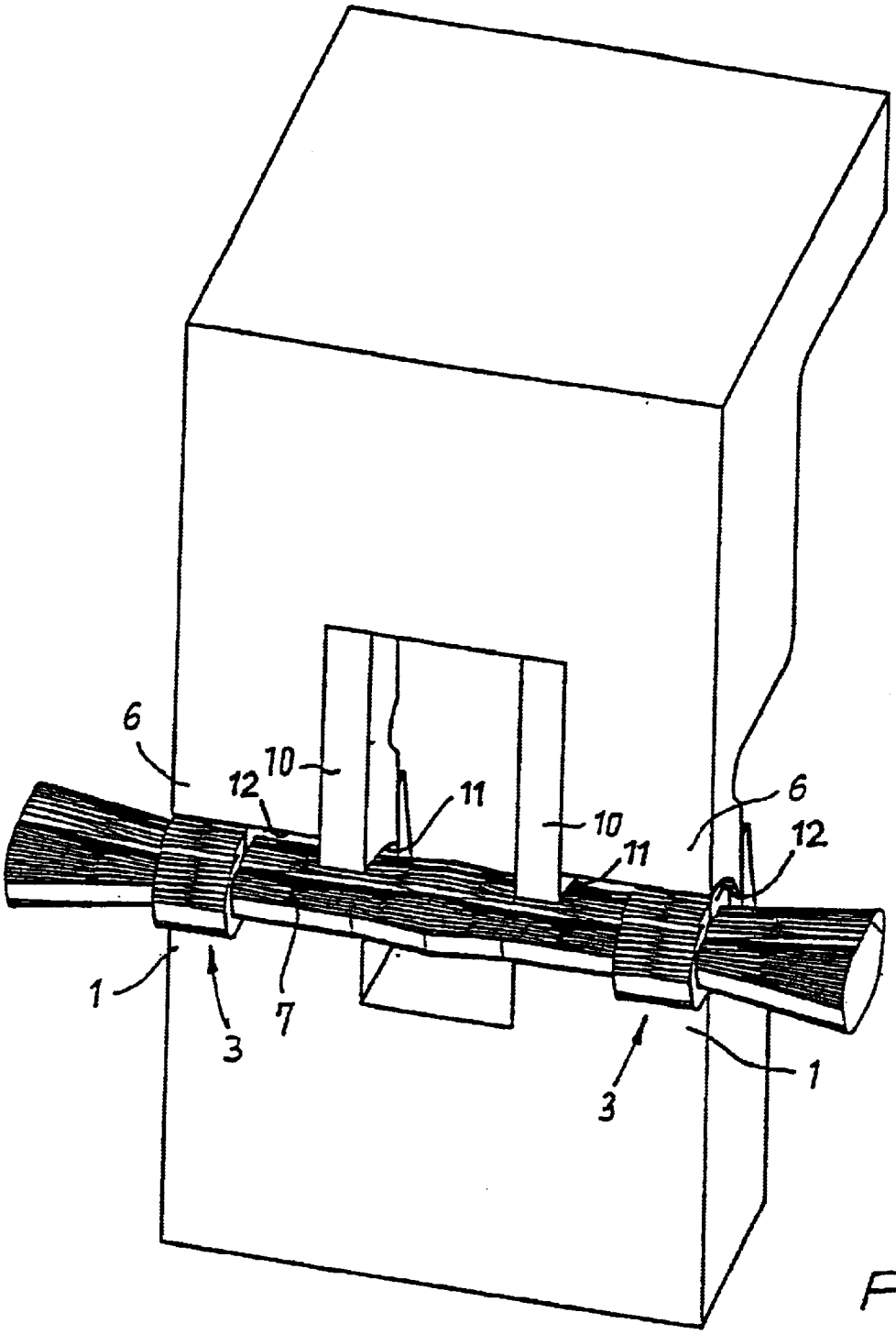

An embodiment of the invention is illustrated in the drawing, in which:

FIG. 1 shows a side view of the inventive closing device in the closing position upon pressing a closure clip around the neck of packaging material cut off; and FIG. 2 shows a perspective front view of the device in a section along line II—II of FIG. 1 with a neck of packaging material closed by means of two closure clips.

With its trough-like recess 2, a matrix 1 encloses a closure clip 3 such that its clip base 4 and its legs 5 are supported (the latter in part). Because the figures of the drawing represent the condition at the end of the closing operation, the punch 6 has already bent the legs 5 of the closure clip 3 around the neck 7 (shown in section in FIG. 1) and has thereby urged the web portions 8 against the outside of the legs 5; moreover, reference can be made to FIGS. 1 and 2 of DE 38 44 052 C1.

At the punch 6, laterally beside the part of the matrix 1 accommodating the closure clip 3, a hold-down device 10 is mounted, whose concave effective area 11 protrudes (downwards) beyond the (likewise concave) working surface 12 of the punch 6 in its direction of movement indicated by the arrow 13. During the working stroke of the punch 6, the effective area 11 of the hold-down device 10 first of all rests against the neck 7 and then urges the same downwards into the closure clip 3 against its clip base 4. Only thereafter, the working surface 12 of the punch 6 closes the closure clip 3 in that it bends the ends of the legs 5 around the neck 7 and in this way closes the closure clip 3 tightly around the neck 7 in the form of a ring by upsetting the closure clip.

FIG. 2 clearly illustrates that when simultaneously setting (as usual) two spaced closure clips 3 on a correspondingly elongated neck 7, which can subsequently be cut through in the middle between the closure clips, a corresponding double matrix 1 with two punches 6 is provided, between which the two hold-down devices 10 are disposed. It can be seen how between the hold-down devices 6 the portion of the neck 7 disposed there is expanded in a barrel-shaped way, whereas it has maintained its gathered position towards the closure clips 3.

What is claimed is:

1. A device for closing packages made of flexible material, wherein a portion of the flexible material is gathered to form a neck and the same is inserted into an open, substantially U-shaped closure clip with a clip base and clip legs on both sides, by placing the neck over said base and between said legs, so that one portion of said neck is directly over said base while other portions of said neck overlap said base on two sides, and forcing said overlapping portions in a direction generally perpendicular to said base and generally parallel to said legs, to hold said portion of said neck that is directly over said base against said base, whereupon the legs of the closure clip are bent around the portion of the neck so held against the base, in the form of a ring, comprising a matrix for holding the open closure clip and a punch movable towards the matrix for holding the open closure clip and a punch movable towards the matrix for bending the clip legs around the neck of the packaging material, the punch having a concave working surface, and at least one hold-down device laterally attached to the punch in axial direction of the concave working surface, the effective area of said hold-down device protruding beyond the working surface of the punch in its direction of movement.

2. The device according to claim 1, said protrusion is from 1 to 5 mm.

3. The device according to claim 1, wherein the effective area of the hold-down device is curved to be concave transverse to the direction of the neck.

4. The device according to claim 1, further comprising two spaced matrixes and associated punches each for simultaneously closing two closure clips on a neck of packaging material gathered on a corresponding length, and wherein two hold-down devices are disposed between the two punches and are attached to the adjacent punch.

* * * * *